United States Patent [19]

Ragen

[11] 4,354,069

[45] Oct. 12, 1982

[54] SLIDE SWITCH

[75] Inventor: Robert P. Ragen, Milwaukee, WI

[73] Assignee: Clum Manufacturing Co., Inc., Hartland, Wis.

[21] Appl. No.: 147,202

[22] Filed: May 6, 1980

[51] Int. Cl.[3] ..... H01H 15/00

[52] U.S. Cl. ..... 200/16 R; 200/243; 200/277; 200/291; 200/325

[58] Field of Search ..... 200/16 R, 277, 16 A, 200/16 B, 16 C, 16 D, 16 E, 16 F, 161, 243, 291, 325, 155 A, 159 R, 340, 67 AA, 76, 77; 339/39

[56] References Cited

U.S. PATENT DOCUMENTS

| | | | |
|---|---|---|---|
| 2,193,268 | 3/1940 | Catron et al. | 200/16 C |
| 3,015,001 | 12/1961 | Woofter | 200/16 C |
| 3,189,701 | 6/1965 | Brown | 200/277 |
| 3,983,355 | 9/1976 | Hyodo | 200/16 R |

FOREIGN PATENT DOCUMENTS

| | | | |
|---|---|---|---|
| 661524 | 4/1963 | Canada | 200/68 |

*Primary Examiner*—R. L. Moses
*Assistant Examiner*—Morris Ginsburg
*Attorney, Agent, or Firm*—Andrus, Sceales, Starke & Sawall

[57] ABSTRACT

A push-pull switch unit includes a rectangular casing having a threaded mounted hub to clamp the casing to a support wall. The casing has a flat contact wall and an opposed flat latch wall. At least one pair of electrical contacts are secured to the contact wall in selected spaced relation to each other. A contact roller is mounted in a movable carrier within the housing adjacent the contact wall. A latch roller is also mounted in the opposite wall of the carrier in alignment with said contact roller. Springs urge the contact roller and the latch roller outwardly into engagement with the adjacent opposed walls. The opposite flat casing wall includes latch recesses into which the latch roller moves to hold said carrier in position. A push-pull operating rod is secured to the carrier for positioning thereof. The carrier includes an opening in the front wall having an outwardly extending slot defining a resiliently movable opening wall. The push-pull operating rod has a tapered cam end which moves through the opening and a connecting recess into which the opening wall collapses upon alignment to lock the rod to the carrier.

11 Claims, 5 Drawing Figures

SLIDE SWITCH

BACKGROUND OF THE PRESENT INVENTION

This invention relates to a switch apparatus including a movable contact carrier having a bridging contact means selectively engaging spaced contacts and particularly to a push-pull type switch.

Electrical circuits include various switches for opening and closing circuits. One highly developed switch apparatus includes spaced contacts mounted on a suitable support and connected to the circuit leads. A bridging contact is secured to a carrier which is movably mounted on the support and is mechanically positioned in an aligned and bridging position engaging with the spaced contacts or alternately in a non-bridging position spaced from such contacts. In a practical application of such an apparatus, a supporting housing on casing is provided having a contact support wall to which the spaced contacts are secured with internal contacts and external terminals. A contact carrier is slidably supported within the casing and includes a spring-loaded contact plate having a bridging contact urged into sliding engagement with the interior of the flat wall. A push-pull rod is journaled within an opening in the casing with the inner end affixed to the carrier and the outer end formed with a convenient operating knob. Such switches are often used in "blind" applications. For example, such push-pull switches may be secured to a vehicle dashboard. The casing includes a threaded mounting hub formed to the front wall and supporting the operating rod. The hub projects through a dashboard opening and is secured in place by a clamping nut. The knob or handle on the exterior end of the actuating rod is releasably attached as by a threaded connection to permit assembly of the clamping nut to the threaded hub. Various other switch units are similarly constructed with relatively fixed contacts and a movable bridging contact unit.

Reference may be made to the following U.S. Pat. Nos. 2,521,561, 3,198,896 and 3,903,390 for a general disclosure of various switch structures.

The electrical switch art is of course a highly developed technology and generally satisfactory and low cost switch structures are available. However, the switch structures have a finite life, and a particular area of failure exists in the movable contact structures. Thus, conventional push-pull switch units do not operate satisfactorily for example, for a range of 50,000 cycles even though such usage is not unexpected in various applications. Further, push-pull switches are reasonable expensive because of the actuating rod structure and its fixed connection to the carrier.

SUMMARY OF THE PRESENT INVENTION

The present invention is particularly directed to an improved swith unit having one or more pairs of spaced contacts located in spaced relation and a movable bridging contact having a position bridging said spaced contacts. Generally, in accordance with a principle feature of the present invention, a bridging contact carrier is movably mounted relative to spaced contacts, and includes a bridging contact roller which is resiliently urged into engagement with the fixed contacts to establish an electrical connection therebetween. The carrier is connected to a push-pull actuator for selective positioning and latch means is provided to hold the carrier in position relative to the contacts. In one preferred embodiment of the invention, the switch unit includes a substantially closed casing having a flat contact wall and an opposed flat latch wall. At least one pair of electrical contacts are secured to the contact wall in selected spaced relation to each other. A contact roller is mounted in a movable carrier within the housing adjacent the contact wall. A latch roller is also mounted in the opposite flat wall of the carrier in alignment with said contact roller. Springs or other resilient means urge the contact roller and the latch roller outwardly into engagement with the adjacent opposed walls. The contact roller thus moves outwardly of said carrier into engagement with said contact wall and particularly the fixed contacts when in the proper alignment therewith. The opposite flat wall includes latch recesses into which the latch roller moves to hold said carrier in position.

The actuating rod in another unique feature of the present teaching is secured in place by a snap-together fixed connection including a coupling opening and a coupling pin. In a preferred construction, the carrier includes an open in the front wall defining a resiliently movable wall permitting movement of a tapered pin member into the opening. The pin has a recess into which the wall lip moves upon alignment to lock the rod to the carrier.

The present invention thus provides a reliable, economical switch unit having an extended operating life becaus of the unique bridging contact roller assembly. The snap-in rod member provides a practical implementation of an enclosed switch assembly for attachment in a restricted environment and particularly a blind type mounting.

DESCRIPTION OF THE ILLUSTRATED DRAWING FIGURES

The drawing furnished herewith illustrate a preferred construction of the present invention in which the above advantages and features are clearly disclosed as well as others which will be readily understood from the following description.

DESCRIPTION OF THE ILLUSTRATED EMBODIMENT

Figure 1:
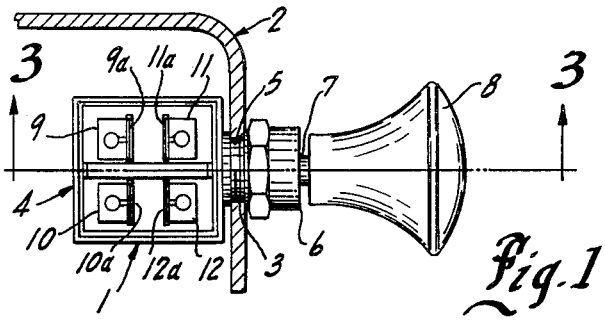
FIG. 1 is a fragmentary cross-sectional view of dash-mounted switch units of the push-pull construction.

Referring to the drawings and particularly to FIG. 1, a push-pull switch unit 1 is illustrated mounted within an inverted L-shaped enclosure wall 2, such as the conventional dash-board construction of an automotive, garden tractor or other vehicle. The switch unit 1 is mounted within an opening 3 within the dash-board from the backside of wall 2. Thus, the switch unit 1 includes a switch casing or housing 4 having a threaded mounting hub 5 projecting through the opening 3 and from the front wall 2. A clamping nut 6 is threaded thereon into abutting engagement with wall 2 to securely clamp and affix the switch unit 1 in place. The push-pull switch unit 1 includes a rod-like actuator 7 which extends through the hub 5 into the housing 4, as more fully described hereinafter. The outer end of the rod 7 is provided with an integrated knob 8 for convenient movement thereof and actuation of the switch unit 1. In the illustrated embodiment of the invention, as shown in FIG. 1, the switch unit 1 includes first and second pairs of contacts including a first pair of contacts 9 and 10 and a second pair of contacts 11 and 12. The contacts 9–12 are illustrated as conventional L-shaped contacts having a leg portion shown secured to the one wall of the housing 4 and outwardly projecting terminals 9*a*–12*a* located for convenient connection of the electrical terminals generally by a bayonet-type connection.

The present invention is particularly directed to construction of a rolling contact assembly or unit 13 located within the housing 4 and selectively movable to a first position connecting contacts 9 and 10 or alternatively to a second position connecting contacts 11 and 12. In addition, the interconnection of the rod 7 to the contact carrier unit or assembly 13 is uniquely constructed so as to permit coupling of rod 7 to carrier 13 after in-place mounting the switch unit to wall 2, as more fully discussed hereinafter.

The illustrated switch unit is otherwise typical of low cost, push-pull units which are widely employed in various electrical applications including vehicular apparatus. Thus, other than as necessary to fully describe the illustrated embodiment of the present invention, no further description is given of the construction of the various elements.

Figure 2:
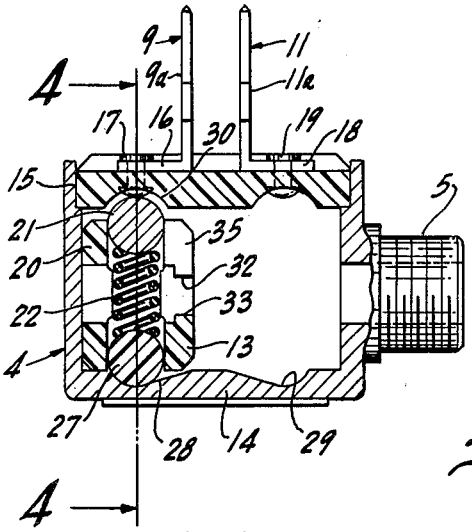
FIG. 2 is a sectional, exploded view of the switch unit shown in FIG. 1.
Figure 2:
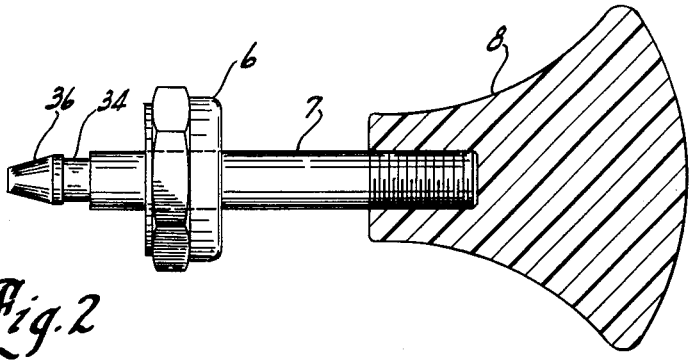
Figure 3:
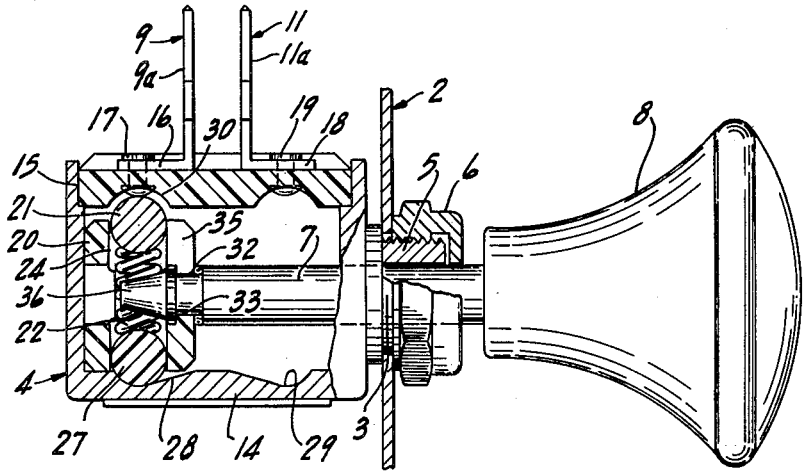
FIG. 3 is a view similar to FIG. 2 with the switch unit assembled.
Figure 4:
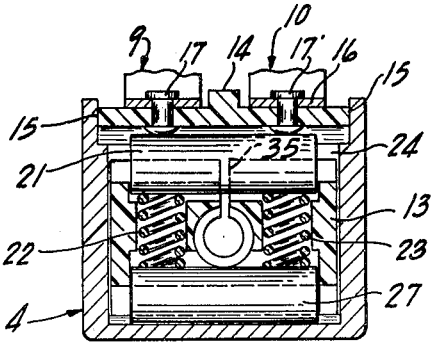
FIG. 4 is a transverse, vertical section taken generally on line 4—4 on FIG. 2.

Referring particularly to FIGS. 2 and 3, the housing 4 includes a generally cup-shaped housing 14 having one side thereof open. A contact carrier plate 15 is secured within the open side and effectively closes the housing, with the carrier unit 13 movably mounted therein. The opening to the cup-shaped housing 14 is slightly recessed and the closure plate 15 is secured therein in suitable fixed relation as by a suitable adhesive and/or a crimp housing 4. The contacts 9, 10, 11, and 12 are suitably secured to the plate 15, and are shown staked in place in accordance with conventional mounting. Referring to particularly FIG. 3, the contact 9, for example, is shown as an L-shaped contact having a base leg 16 secured to the plate 15 by a conductive rivet 17. The contact 11 is similarly constructed with a base leg 18 similarly secured as by a rivet 19 to the plate 15. The contacts 9 and 11 are shown in aligned spaced relationship to each other and forming corresponding sides of the opposite alternate pairs of contacts. The contacts 10 and 12 are similarly constructed and secured to the plate 15 located in similar spaced alignment with contacts 9 and 11 as shown in FIGS. 2–4. The inner ends of the rivets 17 and 17′ and 19 and 19′ are formed as rounded heads to create curved contacts exposed in correspondingly lateral spaced alignment on the interior wall surface of plate 15 for selective connection when aligned with carrier unit 13.

The contact bridging carrier unit 13 includes a contact carrier 20 of suitable insulating material with a contact roller 21 mounted within the carrier in immediate engagement with the interior wall or surface of the contact plate 15. A pair of spaced coil springs 22 and 23 are located within the carrier 20 in alignment with roller 21 and urge the contact roller 21 outwardly into engagement with the aligned contacts 17 and 17′ in the inner position of the carrier unit 13 and with the contacts 19 and 19′ in the outer position of the carrier unit 13. Roller 21 is formed of a suitable conductive material such as brass to establish good conductive contact between the engaged contacts as well as good physical wear characteristics. The carrier 20 is a generally rectangular shaped member substantially complementing the rectangular configuration of the interior of casing 4 and formed of a suitable insulating material such as a well known "Nylon 6—6". Such material has relatively low coefficient of friction and provides a very convenient low friction carrier for sliding, guided movement within the confines of the walls of the rectangular housing. The contact support wall of the carrier 20 is recessed as at 24 to receive the contact roller 21. The depth of the recess 24 is greater than one half of the diameter of the roller 21 such that the recess supports and holds roller 21 properly oriented relative to the contacts 9–12. The roller 21 projects outwardly for contact engagement with the inner contact head portions of fixed contacts 9–12. The coil springs 22 and 23 are located within suitable guide openings 25 and 26 in the contact carrier 20 generally adjacent the opposite ends of the roller and thus substantially in alignment with the aligned portions of the contacts 9–12, inclusive. Thus, in the contact aligned positions, the compression coil springs 22 and 23 resiliently urge the contact roller 21 with the outer curved surface located outwardly of recess 24 and into firm electrical engagement with the fixed contacts 9 and 10, as shown in FIG. 4, to establish a reliable electrical circuit connection therebetween. In the illustrated embodiment of the present invention, the underside of the contact plate 15 is provided with recesses in alignment with the contact rivets 17–19. The adjacent end or surface of the carrier 20 is spaced slightly inwardly of the interior surface of the plate 15 and supports the roller 21. The depth of the recesses are such that the contact roller 21 moves outwardly into the plate recess and engagement with contacts 17–17′ or 19 and 19′, and also moves inwardly into the carrier 20 as the carrier 20 moves within the casing or housing 4 and particularly between the alternate first and second contact positions.

The carrier 20 is releasably latched in position by a latching roller 27 similarly mounted within a recess 28 in the bottom or opposite wall of the carrier 20. The adjacent housing wall is provided with latching recesses 28 and 29 which are located in aligned and opposed relation to the pairs of contacts 17–17′ and 19–19′. The latching roller 27 is urged into engagement with the bottom wall by the coil springs 22 and 23 and when aligned with recess 28 or 29 effectively latches the carrier unit 13 in position within the housing 4. Roller 27 is preferably formed of a low friction plastic material to permit convenient positioning of carrier unit 13 while firmly latching the unit in place. The rolling contact as well as the rolling latching mechanism with latch and loading springs of an appropriate strength permits convenient manual positioning of the carrier. The springs simultaneously establish a firm, electrical contact with the fixed contacts while providing a releasable latch of the carrier unit 13.

The rolling contact roller 21 also provides a very long life contact. Thus, the rolling action continuously presents a new surface to the fixed contacts during each movement of the assembly while minimizing wear and friction during the movement, thereby contributing to a long life contact assembly. Further, the roller structure minimizes the wear on the mechanical construction of the assembly and the loading of the further switch components. Thus, it permits a relatively simple, reliable and inexpensive switch construction. The switch housing can readily be a zinc diecast housing with the threaded mounting hub integrally cast thereto. The closure plate is readily a molded plastic plate which can also be readily secured in position using any suitable well known adhesive.

In the mounting of the push-pull switch units, the clamping nut 6 generally requires that the knob 7 be releasably attached to the rod. Although providing satisfactory operation, the knob may be unthreaded from the rod and lost, and the thread structure is not of minimal costs. In accordance with the illustrated embodiment of the invention, the actuator rod 7 may include a fixed attachment of the knob 8 to the rod 7 and the coupling of the rod 7 to the carrier unit 13 is created after the mounting of the switch unit 1 is in place. The knob 8 may be removably or affixedly secured to the actuator rod 7 and is preferably permanently affixed thereto. Thus, it may be conveniently secured in position by a press fit, with or without the suitable adhesive. Generally the actuating rod 7 is preferably formed of a suitable rigid material such as an inexpensive steel while the outer knob 8 is formed of a suitable plastic or the like in accordance with well known material selections.

Figure 5:
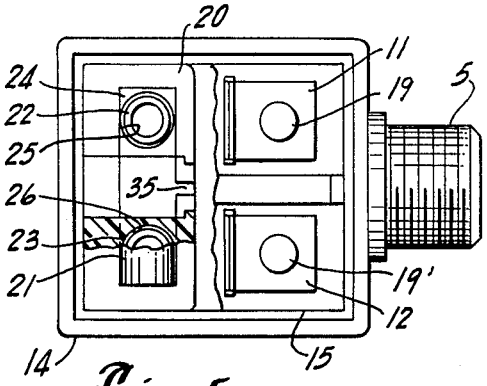
FIG. 5 is a plan view with parts broken away and sectioned to show detail of construction.

The rod 7 is shown secured by a snap-together fitting or coupling to the carrier unit 13 including a coupling opening and mating recess. Thus, referring particularly to FIGS. 3–5, the carrier 20 includes a front wall opening 32 having an inwardly projecting annular lip 33. In the assemblied relation, the lip 33 mates with a recess 34 on the inner end of the rod 7 and provides a firm and fixed connection.

The front wall of the carrier unit also includes a slot 35 extending outwardly to the outer edge of the wall portion. The slot 35 establishes slight deflexibility of the opening 32 permitting the slight spreading or enlargement thereof. The innermost end of the rod 7 projecting from the coupling recess 34 is a tapered or conically shaped end 36 having an inner diameter less than the diameter of the opening 32.

The switch unit 1 is first secured in place including the attachment of the clamping nut 6 without the rod 7 in place. The rod 7 with the affixed plastic knob 8 is passed through the hub 5, which functions as a guide to direct the inner cone-shaped cam end 36 into the opening 32. The inner cam end 36 moves into engagement with the walls of opening 32 and with a minimal snap action force applied to the end of the knob 8, the cam 36 forces the opening 32 to enlarge which is facilitated by the slot 35, permitting the cam end 36 to move through the opening 32. When lip 33 is aligned with the recess 34, the opening lip 33 snaps to the original position into the recess 34 to establish a firm and positive interlock of the rod 7 to the carrier unit 13, for subsequent actuation of the switch unit.

Although shown in a preferred construction, various modifications can of course be readily made to either the rolling contact structure and/or the unique snap-to-together switch actuator connection. For example, the contact roller may be provided with other suitable support assemblies. The fixedly mounted contacts may be moved relative to the contact roller. The illustrated embodiment of the invention has been found to provide a highly effective, readily and commercially producible construction employing relatively standard components with the construction and assembly in accordance with known techniques. Obviously any other type of a connection of the actuator can be provided and the snap-together and the snap coupling can of course be modified to other forms of snap-type couplings.

The present invention thus is particularly directed to an effective low cost movable switch unit having a long operating life with reliable circuit connections being made between the spaced contact members.

Various modes in carrying out the invention are contemplated as being within the scope of the following claims, particularly pointing out and distinctly claiming the subject matter which is regarded as the invention.

We claim:

1. A push-pull switch unit comprising a mounting support having an elongated recess, a set of spaced electrical contact means secured in fixed position within said recess of said support and in spaced relation to each other, a contact roller means rotatably mounted and having an axis parallel to said recess and movable into and from said recess, resilient means urging said contact roller means outwardly toward said recess, and means to reciprocally move said support and said contact roller means relative to each other to move said roller means into said recess and thereby to selectively engage said fixed contact means and said roller means to electrically connect said spaced contact means and to move said roller means from said recess, a bridging contact carrier mounted to said support for reciprocal movement past said spaced contact means, an external operating member slidably supported on said support and secured to said carrier for reciprocally positioning said carrier and said roller means into engagement with said spaced electrical contact means, a latch roller means mounted in said carrier in alignment with said contact roller means, said resilient means urging said contact roller means outwardly of said carrier into engagement with said support and said latch roller means outwardly into engagement with said support, said support having latch means for releasably engaging said latch roller means to hold said carrier in a first position with said contact roller means engaging said spaced contact means and in a second position with said contact roller means spaced from said spaced contact means.

2. An electrical switch unit comprising a support housing having a mounting means for securing the switch unit to another member, at least one set of spaced contacts secured in fixed position to said support housing in spaced relation to each other, a moving contact carrier unit movably mounted to said support housing, a contact roller rotatably mounted in predetermined fixed location to said carrier unit, means to move said carrier unit and thereby position said contact roller into and from engagement with said spaced contacts, an actuator connected to said carrier unit and extending from said carrier unit for manually positioning of said carrier unit, said actuator including an outer operating end connected to a rigid rod-like connector terminating at an inner coupling end, said carrier unit having a coupling member aligned with said coupling end of said connector, said coupling end and coupling member defining a snap-together fixed connection including a coupling opening defined by a wall member and a coupling pin member having a holding recess, one of said members including a resiliently mounted movable wall permitting effective enlargement of said opening and movement of the pin member into said opening of said wall member and collapsing of said movable wall after the meshing of said holding recess and said wall member.

3. The electrical switch unit of claim 2 wherein said support housing includes a flat contact wall and an opposed flat wall, said spaced contacts being secured to said contact wall in selected spaced relation, a latch roller mounted in said carrier unit in alignment with said contact roller, resilient means urging said contact roller outwardly of said carrier unit into engagement with said contact wall and said latch roller outwardly into engagement with said opposed flat wall, said flat contact wall and said opposed flat wall each having a recess for releasably engaging said contact roller and said latch roller to hold said carrier unit in a first position with said contact roller engaging said spaced contacts and in a second position with said contact roller spaced from said spaced contacts, and wherein said actuator comprises an external operating member extending into said housing and secured to said carrier unit for positioning said carrier unit and said roller into engagement with said spaced contacts.

4. The electrical switch unit of claim 2 wherein said housing includes a contact wall with said spaced contacts secured therein and said contacts having inner contact portions and outer terminals, said carrier unit includes an insulating sliding block slidally mounted within said housing and having a guide recess in the block opposed to said contact portions and the contact wall of said housing, said contact roller being located within said guide recess in the sliding block, spring means in said sliding block and urging said roller outwardly into engagement with the contact wall.

5. The electrical switch unit of claim 3 wherein said housing includes a latch wall to the opposite side of said sliding block from said contact wall, said sliding block having a latch roller recess in opposed facing relative to said latch wall, a latch roller disposed in said recess, and said spring means acting between said contact roller and said latch roller.

6. The electrical switch unit of claim 5 wherein said housing has an internal rectangularly shaped cavity, said sliding block is a substantially rectangular member corresponding to said cavity and slidably supported by said cavity.

7. The electrical switch unit of claim 2 wherein said carrier unit includes a front wall secured to laterally spaced edge walls, said front wall defining said wall member including said coupling opening and having a slot extending outwardly from said opening to permit said enlargement of said opening, said connector having an inner tapered end portion having a diameter less than said opening and increasing progressively to a diameter slightly larger than said opening, said connector having an annular recess immediately adjacent said tapered end portion.

8. An electrical push-pull switch apparatus comprising a substantially closed casing having a flat contact wall and an opposed flat latch wall, first and second sets of electrical contacts secured to said contact wall in selected spaced relation, each set of electrical contacts including spaced first and second contacts, a bridging contact carrier formed of insulating plastic and mounted within said casing for reciprocal movement across said flat contact wall between said first and second sets of electrical contacts, said carrier being supported by the adjacent walls of said casing, a contact roller mounted in said carrier, a latch roller mounted in said carrier in alignment with said contact roller, first and second resilient means located within said carrier in substantial alignment with said first and second contacts and urging said contact roller outwardly of said carrier into engagement with said contact wall and said latch roller outwardly into engagement with said opposed flat wall, said opposed flat wall having latch recesses for releasably engaging said latch roller to hold said carrier in a first position with said contact roller engaging said first set of contacts and in a second position with said contact roller engaging said second set of contacts, and an external operating member extending into said casing and secured to said carrier between said first and second resilient means for push-pull positioning said carrier and said contact roller into engagement with said first and second sets of electrical contacts and said latch roller into engagement with said latch recesses.

9. The switch apparatus of claim 8 wherein said carrier includes a front wall secured to laterally spaced edge walls, said front wall including a coupling opening and having a slot extending outwardly from said coupling opening to permit resilient enlargement of said coupling opening, said operating member having an inner tapered end portion having a diameter less than said coupling opening and increasing progressively to a diameter slightly larger than said coupling opening, said operating member having an annular recess immediately adjacent said tapered end portion.

10. A switch unit comprising a support having a mounting means for securing said switch unit to another member, a set of spaced contact means secured in fixed position to said support in spaced relation to each other, a contact carrier unit movably mounted to said support and having bridging contact means for selection engagement with said spaced contact means, an actuator member connected to said carrier unit and extending from said carrier unit for manually positioning of said carrier unit, a snap-together fixed connection between said carrier unit and said actuator member and including a coupling opening defined by a wall member and a coupling pin member having a holding recess, one of said members including a resiliently mounted movable wall permitting effective enlargement of said opening and movement of the pin member into said opening of said wall and meshing of said holding recess and said wall member.

11. The switch apparatus of claim 10 wherein said carrier unit includes a front wall secured to laterally spaced edge walls, said front wall defining said wall member including said coupling opening and having a slot extending outwardly from said coupling opening to permit resilient enlargement of said coupling opening, said actuator member including said pin member and said pin member having an inner tapered end portion having a diameter less than said opening and increasing progressively to a diameter slightly larger than said opening, said pin member having an annular recess immediately adjacent said tapered end portion.

* * * * *

UNITED STATES PATENT AND TRADEMARK OFFICE

CERTIFICATE OF CORRECTION

PATENT NO. : 4,354,069

DATED : October 12, 1982

INVENTOR(S) : Robert P. Ragen

It is certified that error appears in the above-identified patent and that said Letters Patent are hereby corrected as shown below:

| | | |
|---|---|---|
| Column 1, | Line 57, | After "improved" cancel "swith" and substitute therefore --- switch ---; |
| Column 4, | Line 27, | After "with" cancel "the"; |
| Column 7, CLAIM 5 | Line 36, | After "facing" cancel "relative" and substitute therefore --- relation ---. |

This certificate supersedes Certificate of Correction issued May 3, 1983.

Signed and Sealed this

*Fourteenth* Day of *August 1984*

[SEAL]

*Attest:*

GERALD J. MOSSINGHOFF

*Attesting Officer*

*Commissioner of Patents and Trademarks*